US009416793B2

(12) United States Patent
Chiou

(10) Patent No.: US 9,416,793 B2
(45) Date of Patent: Aug. 16, 2016

(54) ELECTRONIC DEVICE

(71) Applicant: ASUSTeK COMPUTER INC., Taipei (TW)

(72) Inventor: Ing-Jer Chiou, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 702 days.

(21) Appl. No.: 13/845,061

(22) Filed: Mar. 17, 2013

(65) Prior Publication Data

US 2014/0079541 A1 Mar. 20, 2014

(30) Foreign Application Priority Data

Sep. 18, 2012 (TW) ..... 101134137 A

(51) Int. Cl.

| | |
|---|---|
| ***F04D 29/44*** | (2006.01) |
| ***F04D 29/42*** | (2006.01) |
| ***F04D 17/16*** | (2006.01) |
| ***F04D 25/06*** | (2006.01) |
| ***F04D 29/28*** | (2006.01) |
| ***F04D 29/30*** | (2006.01) |

(52) U.S. Cl.

CPC ..... *F04D 29/4226* (2013.01); *F04D 17/16* (2013.01); *F04D 25/0613* (2013.01); *F04D 29/281* (2013.01); *F04D 29/30* (2013.01)

(58) Field of Classification Search

CPC ..... F04D 29/522; F04D 19/002; F04D 29/30; F04D 25/0613; F04D 17/16; F04D 29/281; F04D 29/4226; F04D 25/064; F04D 17/08

USPC ..... 416/206, 210, 210 R, 223 R, 183; 361/695

See application file for complete search history.

(56) References Cited

U.S. PATENT DOCUMENTS

| | | | | |
|---|---|---|---|---|
| 550,797 | A * | 12/1895 | Marshall | B04C 1/00 415/144 |
| 6,736,610 | B2 * | 5/2004 | Cifarelli | A01M 7/0021 415/102 |
| 2003/0017048 | A1 * | 1/2003 | Lin | F04D 29/30 415/206 |
| 2003/0063974 | A1 * | 4/2003 | Hsieh | F04D 29/30 416/182 |
| 2005/0249604 | A1 * | 11/2005 | Wu | F04D 29/329 416/244 R |
| 2006/0222491 | A1 * | 10/2006 | Shimada | F04D 29/667 415/206 |
| 2009/0162210 | A1 * | 6/2009 | Hwang | F04D 29/281 416/96 R |
| 2009/0169389 | A1 * | 7/2009 | Hwang | F04D 29/281 416/21 OR |

(Continued)

FOREIGN PATENT DOCUMENTS

| | | |
|---|---|---|
| CN | 2658441 | 11/2004 |
| TW | D137329 S1 | 10/2010 |

(Continued)

*Primary Examiner* — Nicholas J Weiss
*Assistant Examiner* — Jason T Newton
(74) *Attorney, Agent, or Firm* — CKC & Partners Co., Ltd.

(57) ABSTRACT

A centrifugal fan includes a housing and a fan body. The housing includes an upper cover and a lower cover. The fan body is disposed in the housing and includes a hub and at least a blade. The hub is pivotally connected to the lower cover. The blade includes an air intake portion and an air exhaust portion. The air intake portion is connected to the peripheral edge of the hub. The air exhaust portion is connected to the air intake portion and is disposed between the upper cover and the lower cover. The width of the air exhaust portion is gradually reduced along a direction away from the air intake portion.

11 Claims, 10 Drawing Sheets

(56) References Cited

U.S. PATENT DOCUMENTS

2012/0045323 A1* 2/2012 Kagawa ..... F04D 29/162
415/206
2013/0052049 A1* 2/2013 Fujimoto ..... F04D 17/16
417/321
2014/0099207 A1* 4/2014 Yuan ..... F04D 25/064
416/198 R
2014/0219789 A1* 8/2014 Horng ..... F04D 29/30
415/206
2015/0037156 A1* 2/2015 Park ..... F04D 29/282
416/186 R
2015/0043158 A1* 2/2015 Hirano ..... G06F 1/203
361/679.48

FOREIGN PATENT DOCUMENTS

TW I337643 B 2/2011
TW I338552 B 3/2011

* cited by examiner

ELECTRONIC DEVICE

CROSS-REFERENCE TO RELATED APPLICATION

This application claims the priority benefit of TW application serial no. 101134137, filed on Sep. 18, 2012. The entirety of the above-mentioned patent application is hereby incorporated via reference herein and made a part of specification.

BACKGROUND OF THE INVENTION

1. Field of the Invention

The disclosure relates to a centrifugal fan.

2. Description of the Related Art

Nowadays, kinds of thin and portable devices gradually become common application tools in daily life.

Electronic devices have a trend to be thinner and have higher performance, the heat dissipation components in the electronic device become smaller due to the reduced inner space. The centrifugal fan is one of the commonly-used active heat dissipation components.

In the design of the centrifugal fan, it considers that the shape of the fan blade may cause deformation when the fan operates. The deformation of the fan blade is increased along a direction away from the rotational axis. To avoid that the fan blade hits the upper cover or the lower cover due to the deformation, the fan blade is usually parallel to the upper cover and the lower cover, and a gap is kept as the space for deformation of the fan blade. However, serious backflow is generated in the air outlet of the centrifugal fan, and the volume and the pressure of the air is reduced at the air outlet.

BRIEF SUMMARY OF THE INVENTION

A centrifugal fan is provided. The centrifugal fan includes a casing and a fan body. The casing includes an upper cover and a lower cover. The fan body is disposed in the casing, and the fan body includes a fan hub and at least a fan blade. The fan hub is connected to the lower cover, and the fan blade includes an air intake portion and an air exhaust portion. The air intake portion is connected to the edge of the fan hub. The air exhaust portion is connected to the air intake portion and disposed between the upper cover and the lower cover. The width of the air exhaust portion is reduced gradually along the direction away from the air intake portion.

In one embodiment, the air exhaust portion includes a cross section vertical to the upper cover and the lower cover, and the cross section includes an upper contour line and a lower contour line. The upper contour line includes an upper close point relative to the upper cover. The lower contour line includes a lower close point relative to the lower cover. The vertical distance from the upper contour line to the upper cover is increased from the upper close point along the direction away from the upper close point, and the vertical distance from the lower contour line to the lower cover is increased along the direction away from the lower close point.

Since the deformation of the fan blade is getting smaller in the direction close to the fan hub and getting larger in the direction away from the fan hub when the fan blade rotates, the distance from the air exhaust portion of the fan blade to the upper cover or the lower cover is reduced with the decrease of the deformation to increase the volume and the pressure of the air in the air outlet.

DETAILED DESCRIPTION OF THE EMBODIMENTS

Figure 1A:
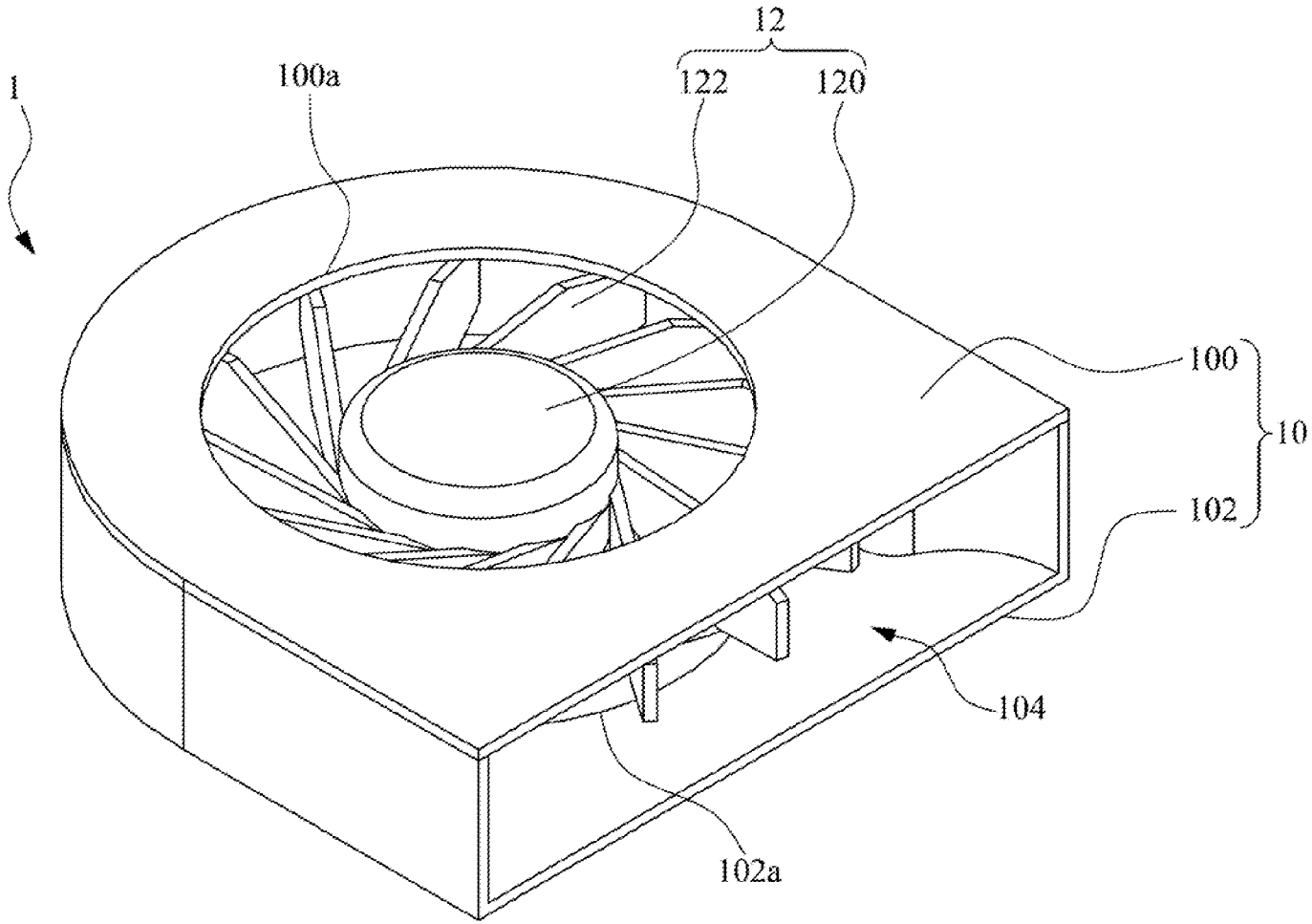
FIG. 1A is a three-dimensional assembly diagram showing a centrifugal fan in one embodiment.
Figure 1B:
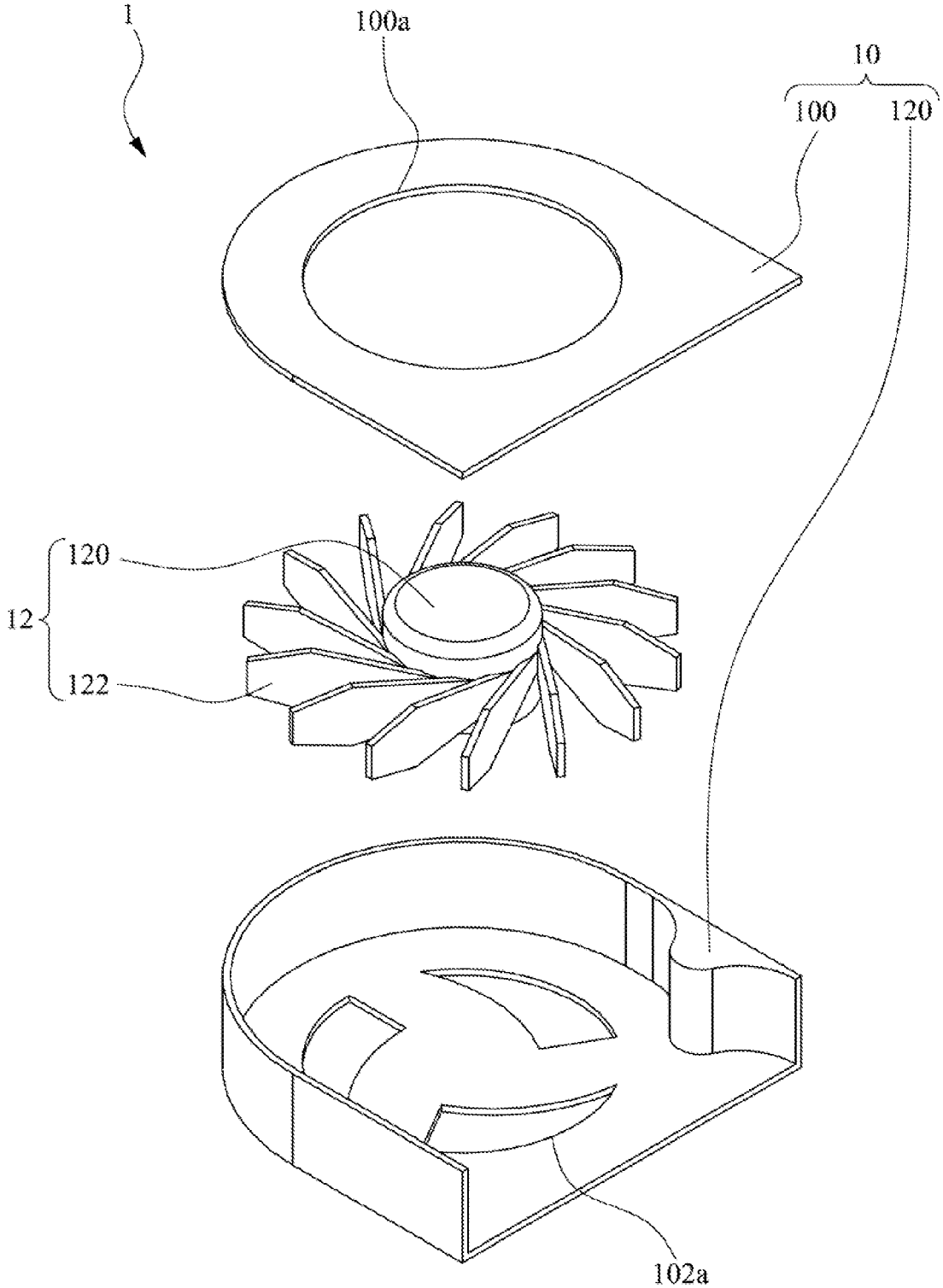
FIG. 1B is a three-dimensional exploded diagram showing the centrifugal fan in FIG. 1A.

FIG. 1A is a three-dimensional schematic diagram showing a centrifugal fan 1 in one embodiment. FIG. 1B is a three-dimensional exploded diagram showing the centrifugal fan 1 in FIG. 1A.

Referring to FIG. 1A and FIG. 1B, an electronic device with the centrifugal fan 1 may be any electronic device with a heat source inside. The centrifugal fan 1 can be used at any electronic device as long as it has a heat dissipation requirement inside.

Referring to FIG. 1A and FIG. 1B, the centrifugal fan 1 includes a casing 10 and a fan body 12. The casing 10 includes an upper cover 100 and a lower cover 102, and the upper cover 100 includes an air inlet 100*a*. When the upper cover 100 of the casing 10 is combined with the lower cover 102, an air outlet 104 is formed at the edge of the same side of the upper cover 100 and the lower cover 102. The fan body 12 includes a fan hub 120 and a plurality of fan blades 122. The fan body 12 is disposed in the casing 10 and between the upper cover 100 and the lower cover 102. The fan hub 120 of the fan body 12 is pivotally connected to a motor (not shown) at the lower cover 102 and faces to an air inlet 100*a* of the upper cover 100.

When the fan body 12 is driven by the motor, the fan blade 122 brings the air outside the casing 10 into the casing 10 via the air inlet 100*a* and exhausts the air out of the casing 10 via the air outlet 104. Moreover, an air intake opening 102*a* can be formed at the portion of the lower cover 102 facing to the air inlet 100*a* of the upper cover 100.

Figure 2:
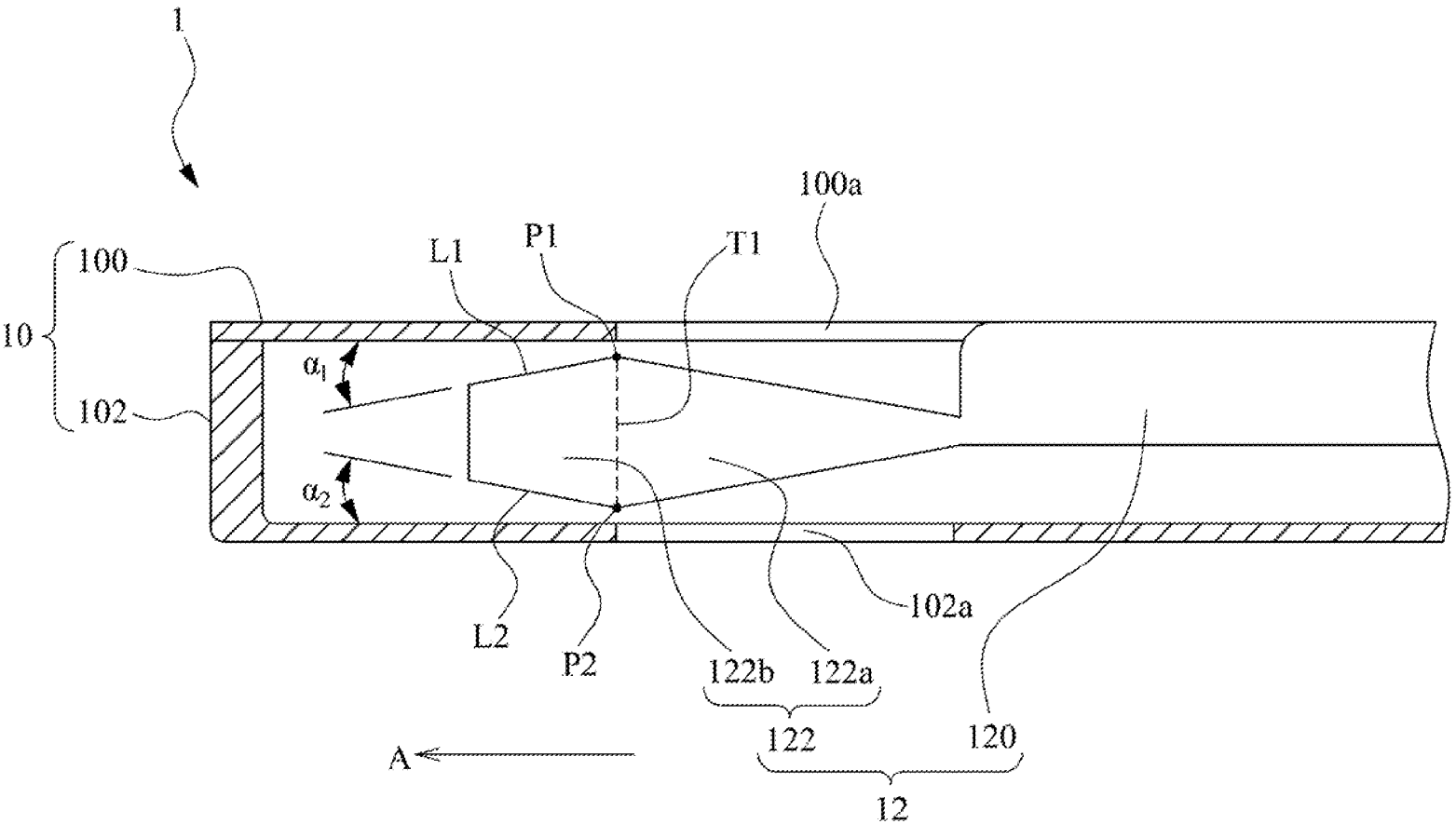
FIG. 2 is a partial sectional schematic diagram showing a cross section of the centrifugal fan in FIG. 1A along a line vertical to the upper cover and the lower cover, wherein the fan body is shown by a contour line.

FIG. 2 is a partial sectional schematic diagram showing a cross section of the centrifugal fan 1 in FIG. 1A along a line vertical to the upper cover 100 and the lower cover 102, and the fan body 12 is shown by a contour line.

The fan blade 122 includes an air intake portion 122*a* and an air exhaust portion 122*b*. The air intake portion 122*a* is connected to the edge of the fan hub 120, and the air exhaust portion 122*b* is connected to the air intake portion 122*a*. When the fan body 12 rotates, the air intake portion 122*a* brings the air outside the casing 10 into the casing 10 via the air inlet 100*a* of the upper cover 100, and the air exhaust portion 122*b* exhausts the air out the casing 10 via the air outlet 104 when it rotates to the air outlet 104.

The air exhaust portion 122*b* is between the upper cover 100 and the lower cover 102, and the air exhaust portion 122*b* includes an upper contour line L1 and a lower contour line L2. The upper contour line L1 includes an upper close point P1 (that is the point of the upper contour line L1 closest to the upper cover 100) relative to the upper cover 100. The lower contour line L2 includes a lower close point P2 (that is the point of the lower contour line L2 closest to the lower cover 102) relative to the lower cover 102. The vertical distance between the upper contour line L1 and the upper cover 100 is increased from the upper close point P1 along the direction A away from the upper close point P1 (that is, away from the fan hub 120).

The vertical distance between the lower contour line L2 and the lower cover 102 is increased from lower close point P2 along the direction A away from the lower close point P2 (that is, away from the fan hub 120). A connection between the upper close point P1 of the upper contour line L1 and the lower close point P2 of the lower contour line L2 can be regarded as a turning region T1 between the air intake portion 122*a* and the air exhaust portion 122*b*. The width of the air exhaust portion 122*b* of the fan blade 122 is reduced gradually from the turning region T1 along the direction A far away the fan hub 120.

In this embodiment, the turning region T1 of the fan blade 122 is disposed at the edge of the air inlet 100*a* of the upper cover 100 (that is the upper close point P1 of the upper contour line L1 and the lower close point P2 of the lower contour line L2 is aligned with the edge of the air inlet 100*a*), which is not limited herein. The turning region T1 of the fan blade 122 also can be formed at the portion even further away from the fan hub 120 along the direction A away from the fan hub 120 (for example the upper close point P1 of the upper contour line L1 and the lower close point P2 of the lower contour line L2 are between the upper cover 100 and the lower cover 102 but not at the edge of the air inlet 100*a*).

In this embodiment, the angle $\alpha 1$ between the upper contour line L1 of the air exhaust portion 122*b* and the upper cover 100 is same to the angle $\alpha 2$ between the lower contour line L2 and the lower cover 102, which is not limited herein. In another embodiment, the distance between the upper close point P1 and the fan hub 120 is different from that between the lower close point P2 and the fan hub 120, and the angle $\alpha 1$ between the upper contour line L1 and the upper cover 100 is different from the angle $\alpha 2$ between the lower contour line L2 and the lower cover 102.

Furthermore, in the condition that the width of the fan blade 122 is gradually reduced from the turning region T1 along the direction A away from the fan hub 120, the upper contour line L1 and the lower contour line L2 of the air exhaust portion 122*b* can be various according to deformation direction of the fan blade 122 when the fan body 12 rotates in the casing 10.

Figure 3:
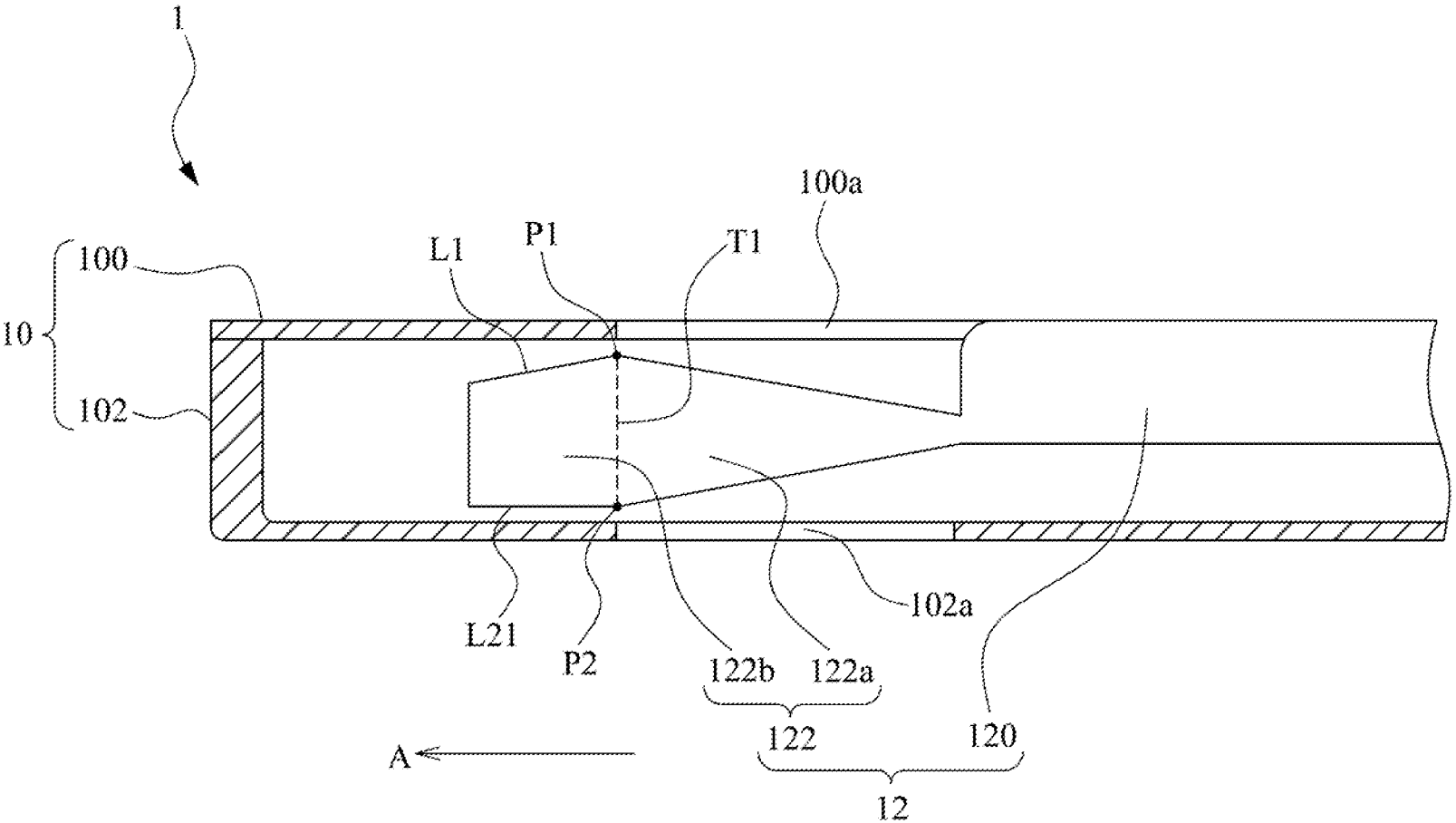
FIG. 3 is a partial sectional schematic diagram showing the centrifugal fan in FIG. 2 in a second embodiment.
Figure 4:
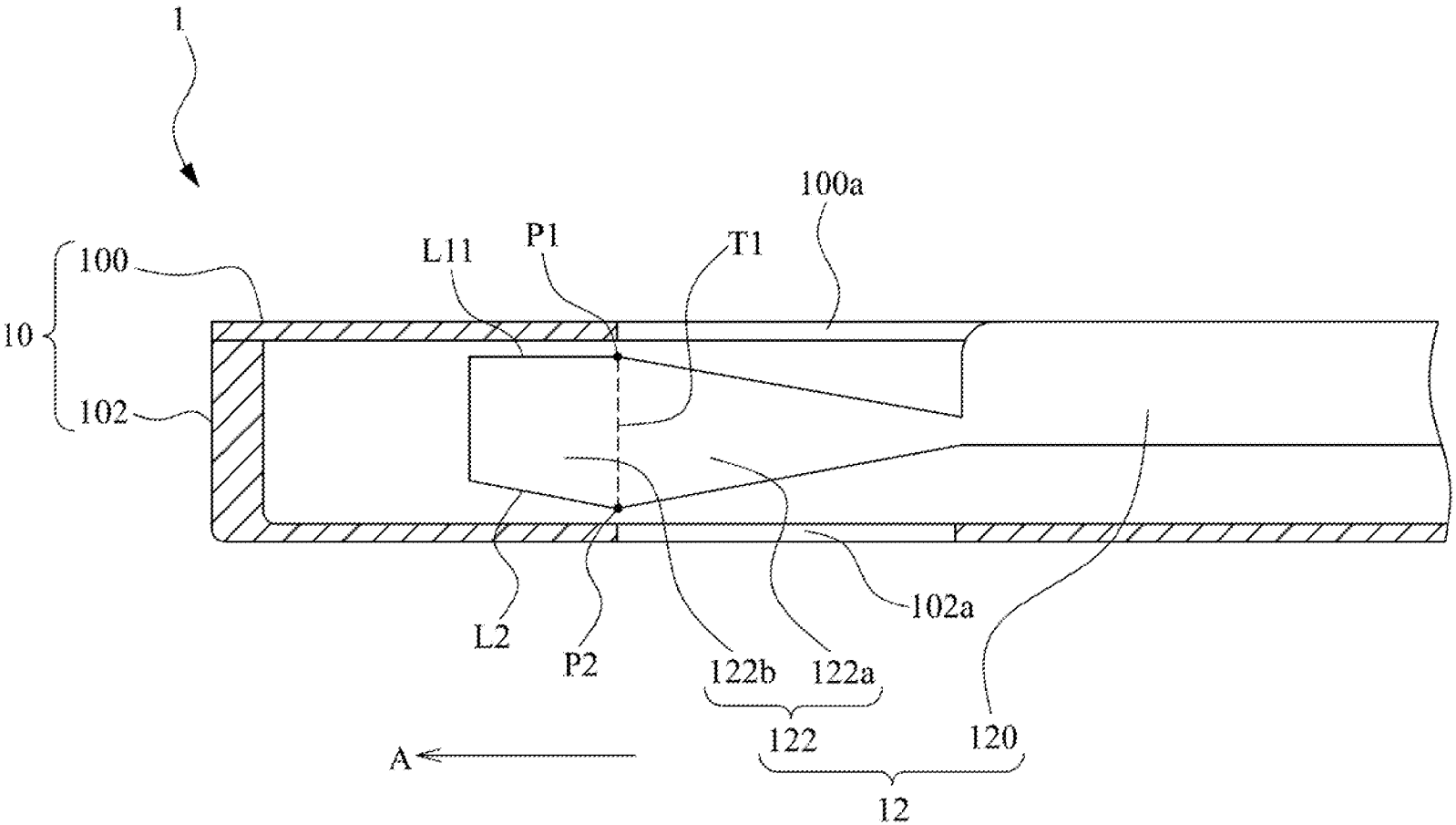
FIG. 4 is a partial sectional schematic diagram showing the centrifugal fan in FIG. 2 in a third embodiment.
Figure 5:
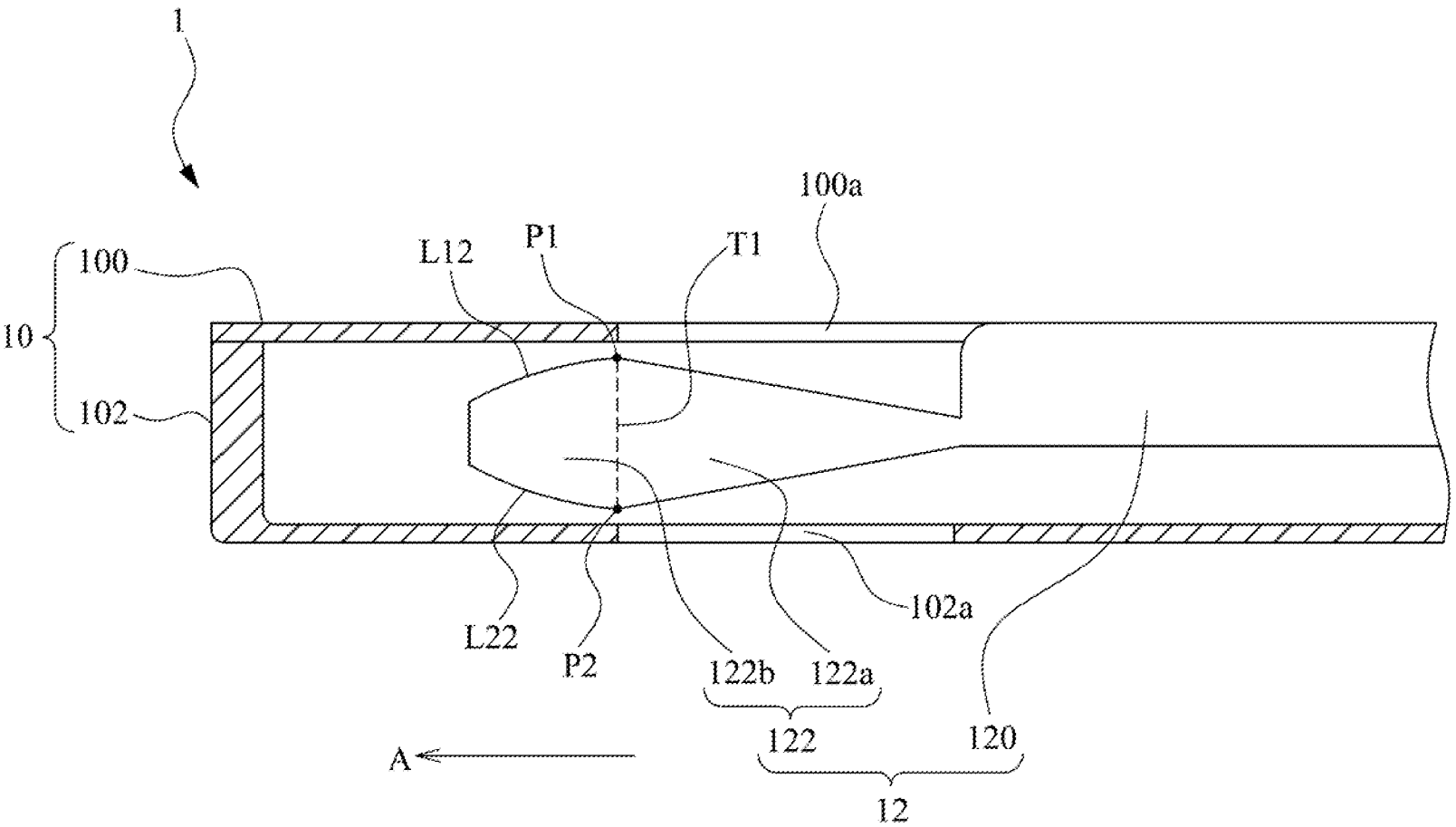
FIG. 5 is a partial sectional schematic diagram showing the centrifugal fan in FIG. 2 in a fourth embodiment.

FIG. 3, FIG. 4 and FIG. 5 are partial sectional schematic diagrams showing the centrifugal fan 1 in FIG. 2 in different embodiments. The same symbols denote the same components in FIG. 2, and the connection of the components is not illustrated any more.

Referring to FIG. 3, if the fan blade 122 deforms toward the upper cover 100 of the casing 10 when the fan body 12 rotates in the casing 10, the vertical distance from the upper contour line L1 of the air exhaust portion 122*b* to the upper cover 100 is increased gradually from the upper close point P1 along the direction A away from the upper close point P1 (that is away from the fan hub 120), and the lower contour line L21 of the air exhaust portion 122*b* is parallel to the lower cover 102 (that is, every point in the lower contour line L21 can be regarded as the lower close point P2).

Referring to FIG. 4, if the fan blade 122 deforms toward the casing 10 of the lower cover 102 when the fan body 12 rotates in the casing 10, the vertical distance from the lower contour line L2 of the air exhaust portion 122*b* to the lower cover 102 is increased gradually from the lower close point P2 along the direction A away from the lower close point P2 (that is, the direction away from the fan hub 120), and the upper contour line L11 of the air exhaust portion 122*b* is parallel to the upper cover 100 (that is, every point of the upper contour line L11 can be regard as the upper point P1).

The upper contour line L1 and the lower contour line L2 of the air exhaust portion 122*b* are straight lines in the embodiment, which is not limited herein.

Referring to FIG. 5, the difference between the embodiment in FIG. 5 and the embodiment in FIG. 2 is that the upper contour line L12 and the lower contour line 122 of the air exhaust portion 122*b* are curve lines.

However, one of the upper contour line L1 and the lower contour line L2 in FIG. 2 also may be a straight line, and the other is a curve line.

Figure 6:
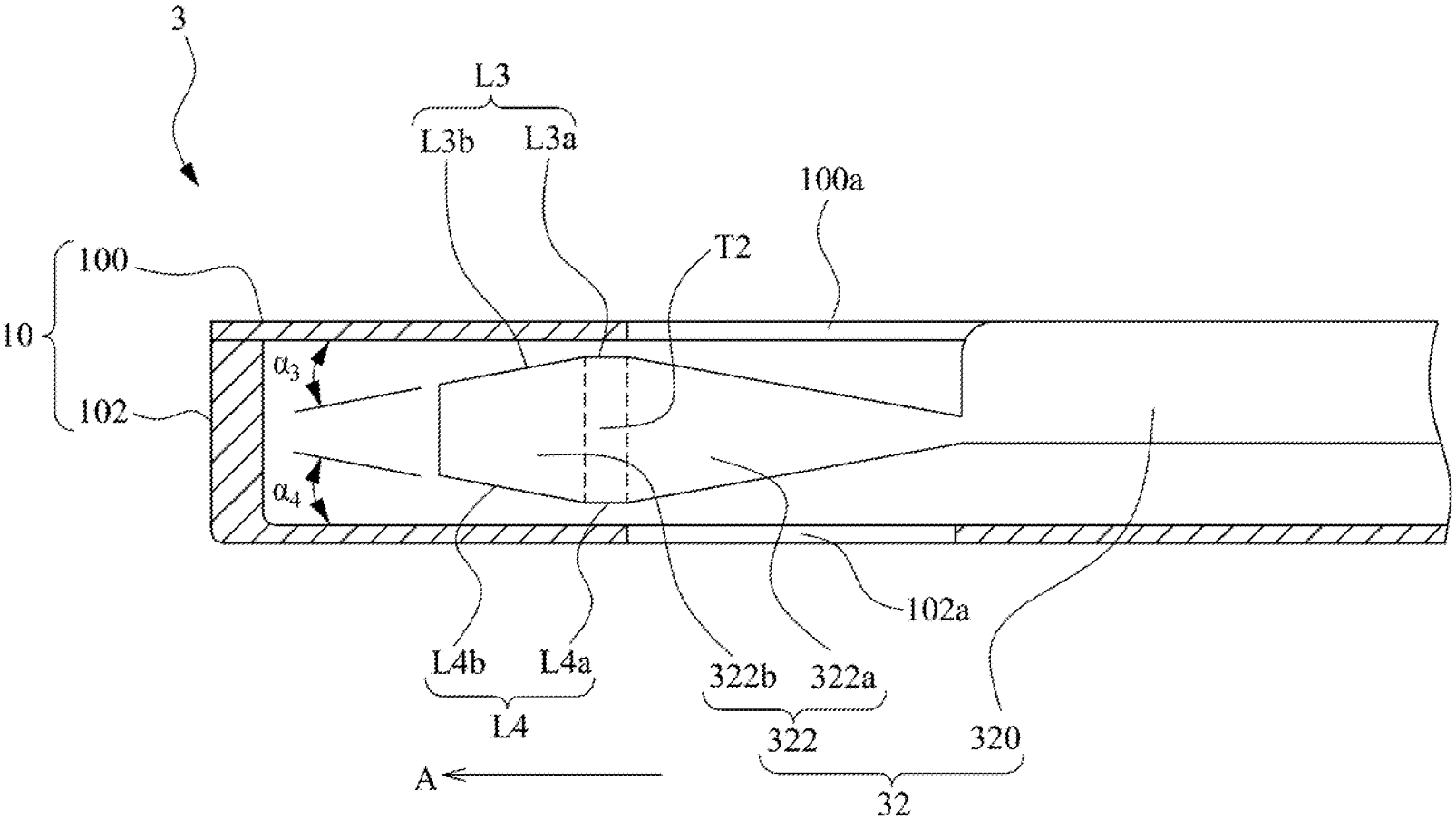
FIG. 6 is a partial sectional schematic diagram showing a cross section of the centrifugal fan in FIG. 1A along a line vertical to the upper cover and the lower cover in another embodiment, wherein the fan body is indicated with a contour line.

FIG. 6 is a partial sectional schematic diagram showing the cross section of the centrifugal fan 1 in FIG. 1A along a line vertical to the upper cover 100 and the lower cover 102, and the fan body 32 is shown by a contour line. The casing 10 in this embodiment is same to that in FIG. 2, the structure of the casing 10 is omitted herein.

The air exhaust portion 322*b* of the fan blade 322 is disposed between the upper cover 100 and the lower cover 102, and the air exhaust portion 322*b* includes an upper contour line L3 and a lower contour line L4. The upper contour line L3 includes an upper parallel part L3*a* and an upper oblique part L3*b*. The upper parallel part L3*a* is between the air intake portion 322*a* and the upper oblique part L3*b*, and it is parallel to the upper cover 100.

The vertical distance from the upper oblique part L3*b* to the upper cover 100 is increased gradually along the direction A away from the upper parallel part L3*a* (that is, away from the fan hub 320). The lower contour line L4 includes a lower part L4*a* and a lower oblique part L4*b*. The lower parallel part of the lower contour line L4 is between the air intake portion 322*a* and the lower oblique part L4*b*, and it is parallel to the lower cover 102. The vertical distance from the lower parallel oblique part L4*b* to the lower cover 102 is increased gradually along the direction A away from the lower parallel part L4*a* (that is away from the fan hub 320).

The zone between the upper parallel part L3*a* of the upper contour line L3 and the lower parallel part L4*a* of the lower contour line L4 can be regarded as the turning region T2 of the fan blade 322, and it is formed between the air intake portion 322*a* and the air exhaust portion 322*b*. The width of the fan blade 322 is reduced gradually from the fan hub 320 along the direction A away from the back over region T2.

The turning region T2 of the fan blade 322 is formed at the edge of the air inlet 100*a* at the upper cover 100 (that is, the upper parallel part L3*a* of the upper contour line L3 and the lower parallel part L4*a* of the lower contour line L4 are aligned with the edge of the air inlet 100*a*), which is not limited herein. In one embodiment, the back over region T2 of the fan blade 322 can be even further away from the fan hub 320 along the direction away from the fan hub 320. Moreover, in another embodiment, the turning region T2 of the fan blade 322 can be increased along the direction A away from the fan hub 320 (that is, the length of the upper parallel part L3*a* and the lower parallel part L4*a* is increased along the direction A away from the fan hub 320).

An angle α3 between the upper oblique part L3*b* of the upper contour line L3 and the upper cover 100 is same to an angle α4 between the lower oblique part L4*b* of the lower contour line L4 and the lower cover 102, which is not limited herein. In another embodiment, the distance from the fan hub 320 to the intersection of the upper parallel part L3*a* and the upper oblique part L3*b* is different from that from the fan hub 320 to the Intersection of the lower parallel part L4*a* and the lower oblique part L4*b*. Consequently the angle α3 between the upper oblique part L3*b* and the upper cover 100 is different from the angle α4 between the lower oblique part L4*b* and the lower cover 102.

Moreover, in the condition that the width of the fan blade 322 is reduced gradually from the back over region T2 along the direction A away from the fan hub 320, the upper contour line L3 and the lower contour line L4 of the air exhaust portion 322*b* can be various according to deformation direction of the fan blade 322 when the fan body 32 rotates in the casing 10.

Figure 7:
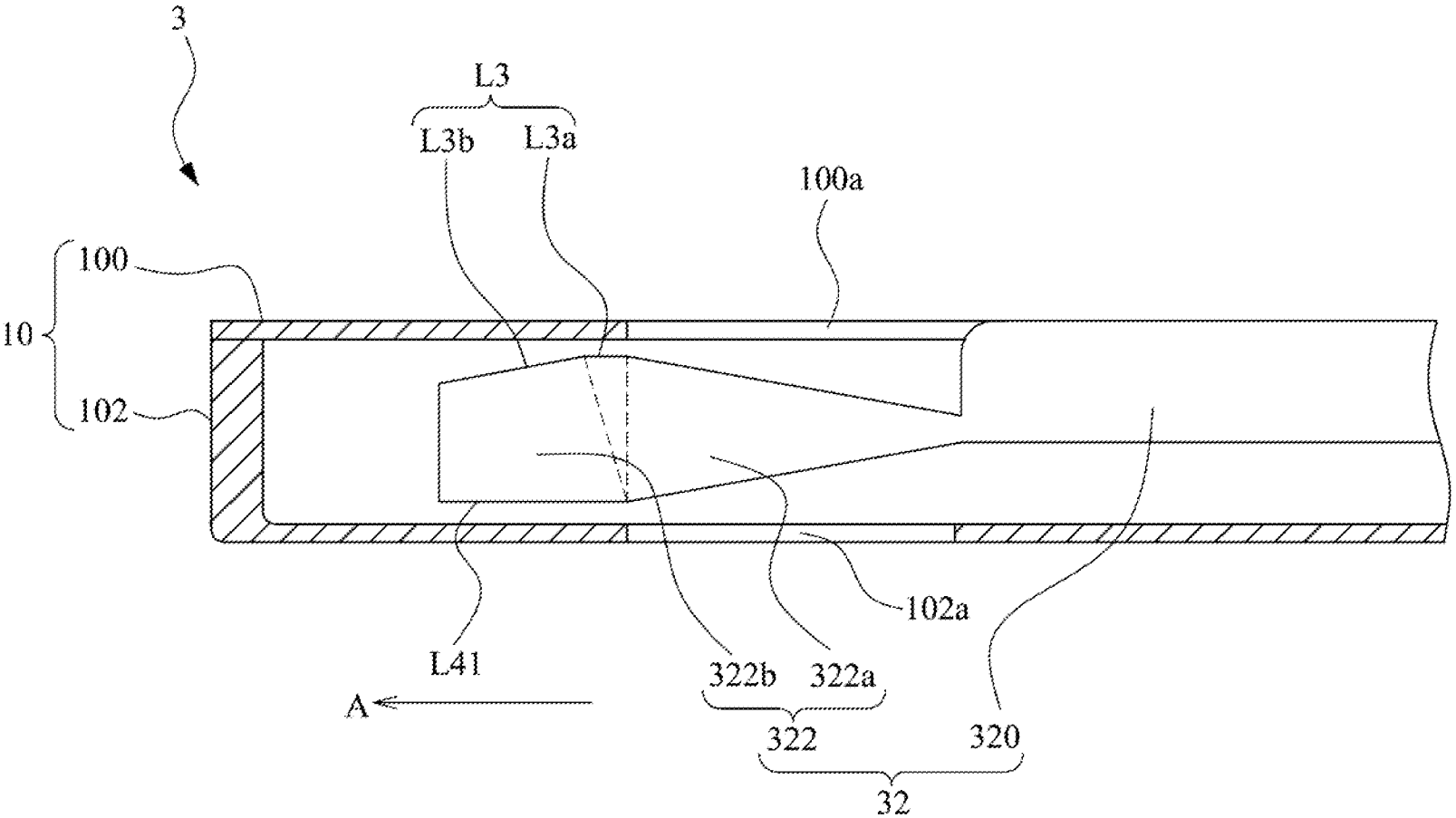
FIG. 7 is a partial sectional schematic diagram showing a centrifugal fan in FIG. 6 in a second embodiment.
Figure 8:
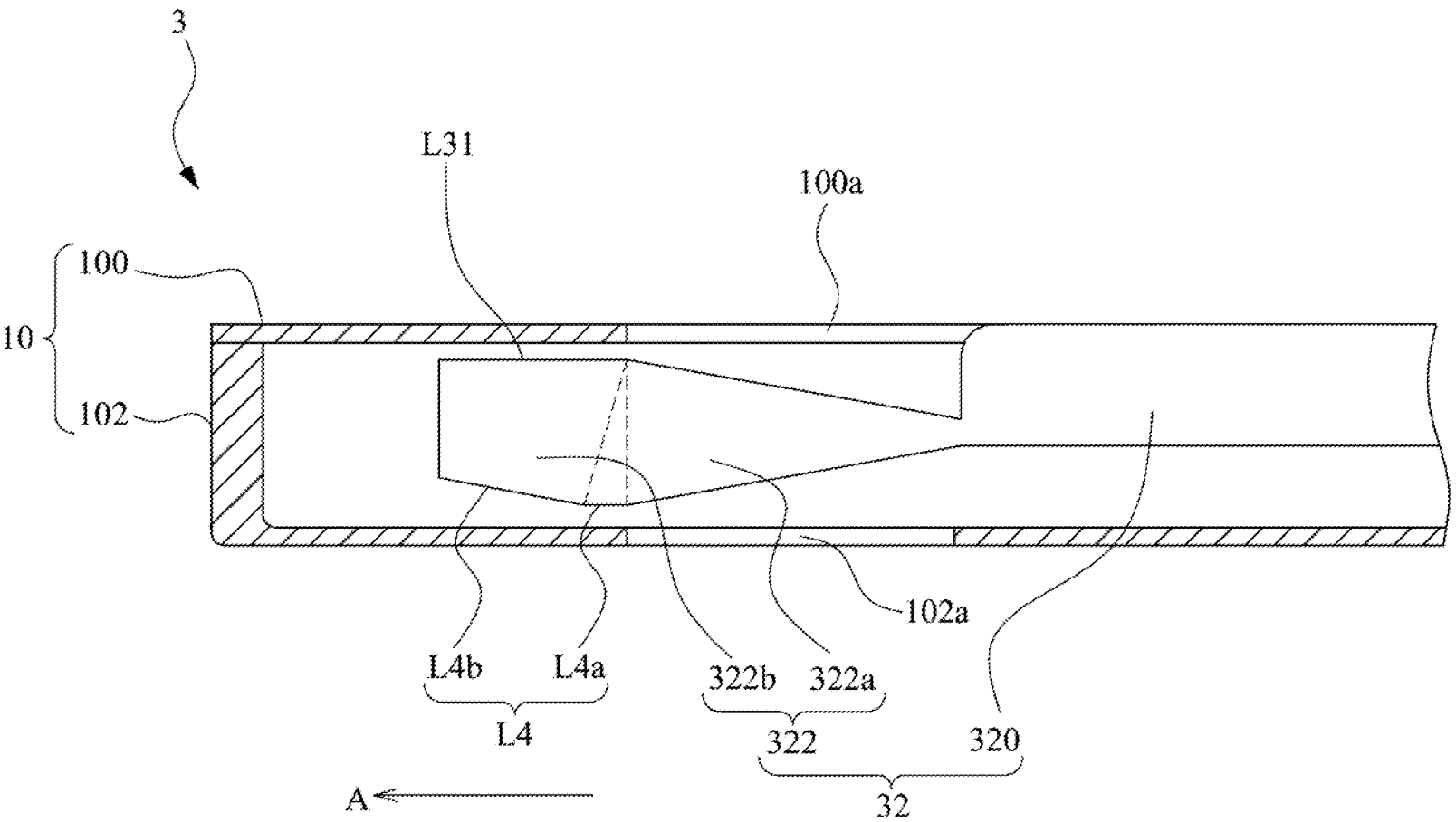
FIG. 8 is a partial sectional schematic diagram showing a centrifugal fan in FIG. 6 in a third embodiment.
Figure 9:
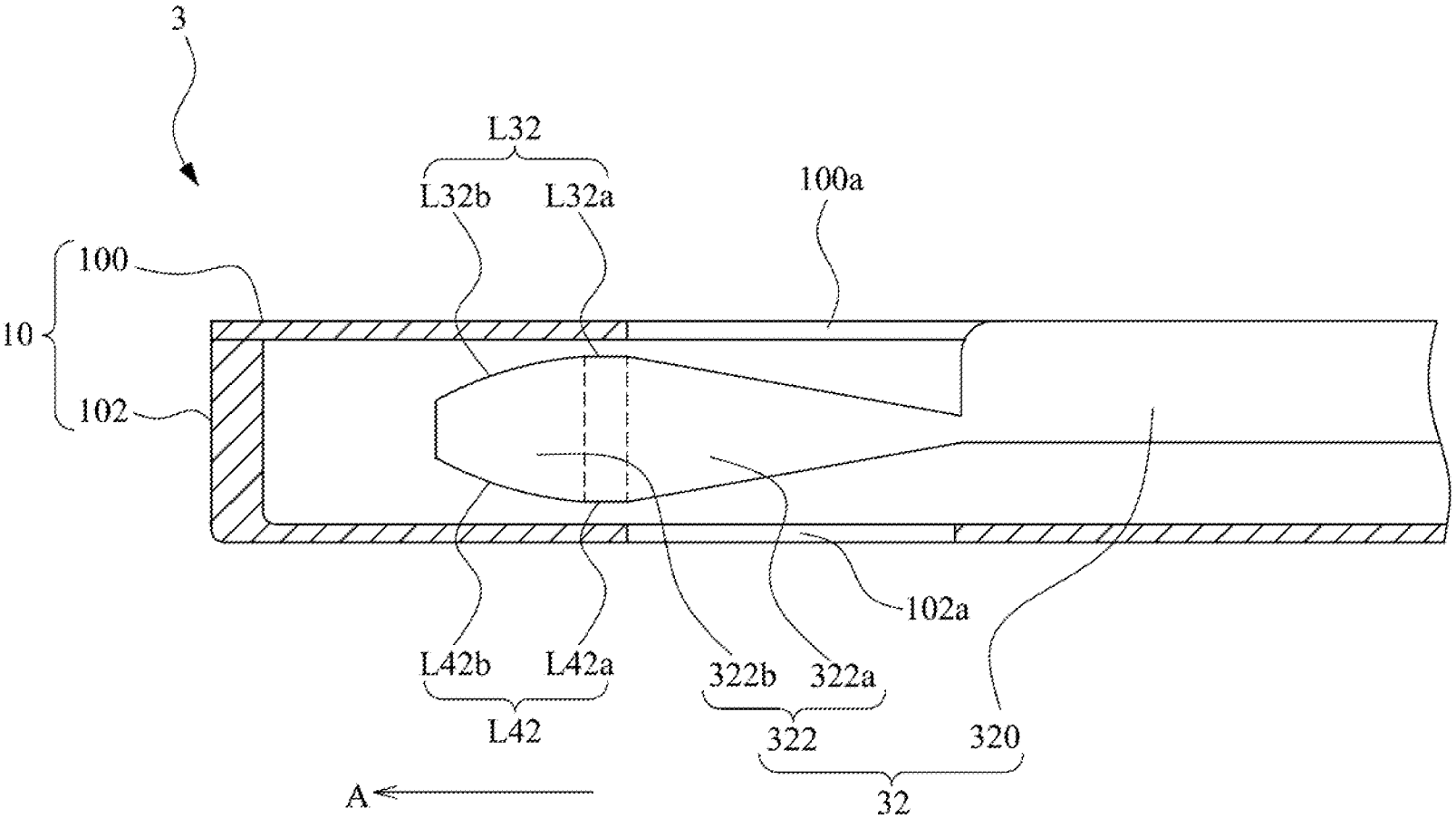
FIG. 9 is a partial sectional schematic diagram showing a cross section of the centrifugal fan in FIG. 6 in a fourth embodiment.

FIG. 7, FIG. 8 and FIG. 9 are partial sectional schematic diagrams showing the centrifugal fan 3 in FIG. 6 in different embodiments, in these embodiments, the same symbols denote the same components in FIG. 6, and the connection of the components is not illustrated any more.

Referring to FIG. 7, if the fan blade 322 deforms toward the upper cover 100 of the casing 10 when the fan body 32 rotates in the casing 10, the vertical distance from the upper oblique part L3*b* of the upper contour line L3 to the upper cover 100 is increased gradually along the direction A away from the upper parallel part L3*a* (that is away from the fan hub 320), and the lower contour line L41 of the air exhaust portion 322*b* is parallel to the lower cover 102.

Referring to FIG. 8, if the fan blade 322 deforms toward the lower cover 102 of the casing 10 when the fan body 32 rotates in the casing 10, the vertical distance from the lower oblique part L4*b* of the lower contour line L4 to the lower cover 102 is increased gradually along the direction A away from the lower parallel L4*a* (that is away from the fan hub 320), and the upper contour line L31 is parallel to the upper cover 100.

The upper oblique part L3*b* of the upper contour line L3 and the lower oblique part L4*b* of the lower contour line L4 are straight lines, which is not limited herein.

Referring to FIG. 9, the difference between the embodiment in FIG. 9 and that in FIG. 6 is the upper oblique part L32*b* of the upper contour line L32 and the lower oblique part L42*b* of the lower contour line L42 in the air exhaust portion 322*b* are curve lines.

However, one of the upper oblique part L3*b* of the upper contour line L3 and the lower oblique part L4*b* of the lower contour line L4 also may be a straight line and the other is a curve line.

In sum up, the gap between the fan blade and the tipper cover or the lower cover is reduced according to the embodiments. Consequently, the loss of the air backflow from the air outlet to the air inlet of the fan blade is reduced, and the volume and pressure of the exhausted air are increased.

Although the present disclosure has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A centrifugal fan, comprising:

a casing including a upper cover and a lower cover; and a fan body disposed in the casing, wherein the fan body includes:

a fan hub pivotally connected to the lower cover; and a fan blade, wherein the fan blade includes an air intake portion and an air exhaust portion, the air intake portion is connected to an outer edge of the fan hub, the air exhaust portion is connected to the air intake portion and disposed between the upper cover and the lower cover, and the width of the air exhaust portion is reduced along a direction away from the air intake portion;

wherein a cross section of the air exhaust portion vertical to the upper cover and the lower cover includes an upper contour line and a lower contour line, the upper contour line includes a upper close point relative to the upper cover, the lower contour line includes a lower close point relative to the lower cover, and the upper close point and the lower close point are aligned with the edge of the air inlet in an axial direction of the fan body;

wherein among all elements of the centrifugal fan, in the axial direction, the upper cover is the element closest to the upper contour line in the centrifugal fan, and the lower cover is the element closest to the lower contour line in the centrifugal fan.

2. The centrifugal fan according to claim 1, wherein a vertical distance from the upper contour line to the upper cover is increased along a direction away from the upper close point, and the vertical distance of the lower contour line relative to the lower cover is increased along a direction away from the lower close point.

3. The centrifugal fan according to claim 2, wherein the upper contour line is a straight line or a curve line.

4. The centrifugal tan according to claim 2, wherein the lower contour line is a straight line or a curve line.

5. The centrifugal fan according to claim 2, wherein the upper contour line and the lower contour line are straight lines and an angle between the upper contour line and the upper cover is same to an angle between the lower contour line and the lower cover.

6. The centrifugal fan according to claim 1, wherein the upper contour line includes an upper parallel part and an upper oblique part, the upper parallel part is parallel to the upper cover, and a vertical distance from the upper oblique part to the upper cover is increased along a direction away from the upper parallel part.

7. The centrifugal fan according to claim 6, wherein the upper oblique part is a straight line or a curve line.

8. The centrifugal fan according to claim 1, wherein the lower contour line includes a lower parallel part and a lower oblique part, the lower parallel part is parallel to the lower cover, and a vertical distance from the lower oblique part to the lower cover is increased along a direction away from the lower parallel part.

9. The centrifugal fan according to claim 8, wherein, the lower oblique part is a straight line or a curve line.

10. A centrifugal fan, comprising:

a casing including a upper cover and a lower cover, wherein the upper cover is formed with an air inlet; and a fan body disposed in the casing, wherein the fan body comprises:

a fan hub pivotally connected to the lower cover; and a fan blade, wherein the fan blade includes an air intake portion and an air exhaust portion, the air intake portion is connected to an outer edge of the fan hub, the air exhaust portion is connected to the air intake portion and disposed between the upper cover and the lower cover, and the width of the air exhaust portion is reduced along a direction away from the air intake portion;

wherein, when viewing a profile of the fan blade in a vertical cross section of the centrifugal fan, the air exhaust portion includes an upper contour line and a lower contour line, the upper contour line including an upper close point whereat the air exhaust portion is closest to the upper cover and the lower contour line including a lower close point whereat the air exhaust portion is closest to the lower cover, and wherein the air exhaust portion is connected to the air intake portion at a turning region interconnecting the upper close point and the lower close point, and the turning region is aligned with an edge of the air inlet in an axial direction of the fan body;

wherein among all elements of the centrifugal fan, in the axial direction, the upper cover is the element closest to the upper contour line in the centrifugal fan, and the lower cover is the element closest to the lower contour line in the centrifugal fan.

11. The centrifugal an according to claim 10, wherein, when viewing the profile of the fan blade in a vertical cross section of the centrifugal fan, the air intake portion gradually reduces in height radially inwardly from the turning region.

* * * * *